US010364621B2

(12) United States Patent
Patel et al.

(10) Patent No.: US 10,364,621 B2
(45) Date of Patent: Jul. 30, 2019

(54) PIPE HANDLING FOR A DRILL STRING AT GROUND EXIT

(71) Applicant: American Augers, Inc., West Salem, OH (US)

(72) Inventors: Kalpeshkumar Patel, Copley, OH (US); Christopher Zambie, Huntsville, AL (US); Richard Gentry, Wooster, OH (US)

(73) Assignee: American Augers, Inc., West Salem, OH (US)

( * ) Notice: Subject to any disclaimer, the term of this patent is extended or adjusted under 35 U.S.C. 154(b) by 287 days.

(21) Appl. No.: 15/419,685

(22) Filed: Jan. 30, 2017

(65) Prior Publication Data

US 2017/0218709 A1 Aug. 3, 2017

Related U.S. Application Data

(60) Provisional application No. 62/288,551, filed on Jan. 29, 2016.

(51) Int. Cl.

| | |
|---|---|
| ***E21B 19/16*** | (2006.01) |
| ***E21B 7/04*** | (2006.01) |
| *E02F 3/96* | (2006.01) |

(52) U.S. Cl.

CPC ..... *E21B 19/168* (2013.01); *E21B 7/046* (2013.01); *E21B 19/16* (2013.01); *E21B 19/161* (2013.01); *E02F 3/96* (2013.01); *E21B 19/163* (2013.01); *E21B 19/164* (2013.01)

(58) Field of Classification Search

CPC ..... E21B 19/16; E21B 19/161; E21B 19/168; E21B 19/162–164

See application file for complete search history.

(56) References Cited

U.S. PATENT DOCUMENTS

| | | | | |
|---|---|---|---|---|
| 5,060,542 | A | 10/1991 | Hauk | |
| 6,179,065 | B1 | 1/2001 | Payne et al. | |
| 6,334,376 | B1 | 1/2002 | Torres | |
| 8,074,537 | B2 * | 12/2011 | Hunter | E21B 19/168 81/57.16 |
| 8,109,179 | B2 | 2/2012 | Richardson | |
| 8,145,971 | B2 | 3/2012 | Huang | |
| 8,157,495 | B1 | 4/2012 | Randall | |
| 8,348,319 | B2 | 1/2013 | LaValley et al. | |
| 8,490,519 | B2 | 7/2013 | LaValley et al. | |
| 2002/0079105 | A1 | 6/2002 | Bergeron | |
| 2003/0132030 | A1 | 7/2003 | Tompkins | |

(Continued)

*Primary Examiner* — Giovanna C Wright
*Assistant Examiner* — Tara E Schimpf
(74) *Attorney, Agent, or Firm* — Tomlinson McKinstry, P.C.

(57) ABSTRACT

An exit side pipe handling and vise tool. The tool may be suspended from an arm of a hydraulic machine and rotated and pivoted relative to the arm. The tool comprises two retainer assemblies, two vise assemblies, and a roller assembly each suspended from a linear frame. Each of the retainer assemblies is movable relative to the frame in a direction transverse to a length of the frame. The vise assemblies are in side-by-side configuration to break a connection between adjacent pipe segments. The roller assembly defines rollers having a spiral ramp disposed on an external surface to encourage axial movement of a pipe segment during rotation thereof.

17 Claims, 13 Drawing Sheets

(56) References Cited

U.S. PATENT DOCUMENTS

| | | | | |
|---|---|---|---|---|
| 2012/0297933 | A1* | 11/2012 | Lavalley | E02F 3/965<br>81/57.34 |
| 2014/0151124 | A1* | 6/2014 | Randall | E21B 19/16<br>175/52 |
| 2015/0259993 | A1 | 9/2015 | Patel et al. | |

* cited by examiner

PIPE HANDLING FOR A DRILL STRING AT GROUND EXIT

CROSS REFERENCE TO RELATED APPLICATION

This application claims the benefit of U.S. Provisional Patent Application Ser. No. 62/288,551 filed on Jan. 29, 2016, the entire contents of which are incorporated herein by reference.

FIELD

The present invention relates generally to a tool that may be used in connection with a horizontal directional drilling rig that advances a drill string, comprised of a plurality of drill pipes that are joined together in threaded engagement, through the ground to create a borehole, and to a method for using such a tool. More particularly, the invention comprises a tool that is used to perform various functions on or with respect to the drill pipe sections of the drill string on the exit side of the borehole.

BACKGROUND

Many utility lines, pipelines and other underground components are installed in or under the ground by boring a borehole in a generally-horizontal direction in the ground rather than by digging a trench. This type of construction, which is sometimes referred to as "horizontal boring", "directional drilling" or "horizontal directional drilling", eliminates the need to excavate earth in order to install an underground component, and thereby saves several steps in the installation process. If no trench is dug, there will be no trench to fill, and no disturbed surface to reclaim. A directional drilling machine may be operated to drill a borehole along a desired path underground. The planned path is generally arcuate in shape from the entry point at the surface of the ground to an exit point remote from the entry point at the surface. The path of the borehole may take the drill string under or around an obstacle such as a roadway, river or other existing utility.

A typical directional drilling machine includes a thrust frame that can be aligned at an oblique angle with respect to the ground. Mounted on a drive carriage on the thrust frame is a pipe-rotation mechanism that is adapted to rotate the drill string and boring tool connected to the downhole end of the drill string. The drive carriage also includes a carriage drive assembly that is adapted to push the carriage along the thrust frame. The combination of rotation of the drill string and longitudinal movement of the drive carriage along the thrust frame causes the drill string to be advanced into or withdrawn from the ground along the desired path.

To drill a hole using a directional drilling machine, the thrust frame is oriented at an angle relative to the ground, and the drive carriage is positioned at an upper end of the frame. A drill pipe section is coupled to the pipe-rotation mechanism on the drive carriage. A boring tool or cutting head is mounted to the terminal end of the pipe section, and the drive carriage is driven downward along the thrust frame. As the drive carriage is driven downward, the pipe-rotation mechanism rotates the pipe about the boring axis, thereby causing the pipe (with boring tool mounted thereon) to drill or bore a hole.

As the drilling operation proceeds, pipe sections are added to the uphole (entry-side) end of the drill string to lengthen the drill string. The pipe sections are provided with a male threaded connector on one end and a female threaded connector on the other end. Each time a pipe section is added to the drill string, the pipe section being added is aligned with the drill string and the threaded connector on its far end is mated with the threaded connector on the near end of the drill string. Either the pipe section being added or the drill string must be restrained against rotation while the other component is rotated to engage the threaded connector on the far end of the pipe section with the threaded connector on the near end of the drill string to create a secure threaded connection between the components.

Hydraulically actuated wrenches or vises are typically mounted on the directional drilling machine to tighten the threaded connections between drill pipes as pipe sections are added to lengthen the drill string. These wrenches typically comprise two pairs of opposed jaws, one for the male-threaded pipe and the other for the female-threaded pipe of the adjacent components of the drill string. Each pair of jaws is adapted to clamp around a pipe section, one on the far side and the other on the near side of the threaded connection. At least one pair of jaws of the wrench assembly will pivot with respect to the other pair of jaws to twist one of the pipe sections with respect to the other.

After the boring tool reaches a desired depth during the drilling operation, it can be directed along a generally horizontal path and back up to break the surface of the ground at the exit point. To control the direction of the boring tool, a boring tool with an angled-face may be used. When the direction of the boring tool must be changed, the boring tool is positioned with the angled-face oriented to cause the boring tool to deflect in the desired direction and the drill string is pushed forward without rotation. The capability to change the direction of travel of the boring tool allows the operator to steer the boring tool and drill string around underground obstacles.

When the pilot bore is complete, the boring tool may be removed from the end of the drill string, and the pipe sections disconnected from each other to disassemble the drill string on the exit side of the borehole. Additionally, the borehole may be enlarged using a backreamer in place of the boring tool. If a backreamer is used, it will be connected to the far end of the drill string in place of the boring tool and moved through the pilot bore back towards the directional drilling machine, either with or without rotation of the drill string. The backreamer expands and stabilizes the walls of the bore, generally while pulling a utility line or other underground component through the enlarged bore behind it.

Movement of the backreamer towards the drilling machine is accomplished by driving the drive carriage in a rearward direction on the thrust frame to withdraw a pipe section, disconnecting the withdrawn pipe section from the drill string, connecting the next pipe section remaining in the drill string to the pipe rotation mechanism on the drive carriage and repeating the process until all of the pipe sections have been withdrawn from the ground. As each pipe section in the drill string is uncoupled from the drill string using the same wrench assembly that is used to connect the drill pipes when boring is being carried out, the disconnected pipe sections are placed in a stack or loaded into a pipe section magazine of the directional drilling machine.

There are several operations that may be performed on the exit side of the borehole. For example, the boring tool may be disconnected from the end of the drill string and the pipe sections of the drill string may be disconnected one by one from the drill string. If a backreamer is used, it must be installed in place of the boring tool. High torque is typically required in order to loosen the boring tool or a pipe section for removal from the drill string or to install the backreamer on the drill string. Most commonly, the drill crew will use a pair of large wrenches such as pipe wrenches or oil field tongs to remove the boring tool and each pipe section, or to install a backreamer. Frequently, the drill crew will connect the handle of the wrench to the bucket of a hydraulic excavator using a chain or strap, and then use the excavator to apply a vertical force to the bucket while the drilling rig operator rotates the drill string to loosen the boring tool or a pipe section or to tighten the backreamer on the end of the drill string. If the drill string is to be disassembled on the exit side, the individual pipe sections must be placed in a stack or in a pipe section magazine. These pipe sections are heavy and long, and it is labor-intensive to disconnect them manually on the exit side of the drill site.

It would be desirable, therefore, if a tool could be provided that could perform various functions with respect to the drill string on the exit side of the borehole. It would also be desirable if a preferred embodiment of such a tool could be provided that could connect to the arm of a hydraulic machine such as a hydraulic excavator so as to employ the excavator's auxiliary hydraulic power circuit to operate the tool.

Some tools have recently become available for exit-side makeup and breakout. For example, see the tools described in U.S. Patent Publication No. 2014/0151124, issued to Randall, et. al., the entire contents of which are each incorporated herein by reference. The following disclosure provides improvements to the design and operation of such devices.

SUMMARY

The invention is directed to an apparatus comprising an elongate frame, first and second vise assemblies, a retainer assembly and a positioning assembly. The frame has a frame axis. The vise assemblies are supported in side-by-side relationship on the frame. One vise assembly is configured to grip and rotate a pipe section, and the other vise assembly is configured to grip a pipe section without rotation. The retainer assembly is supported on the frame in spaced relationship to the vise assemblies and configured to grip a pipe section without rotation. The positioning assembly is configured to move the retainer assembly in a direction transverse to the frame axis.

In another embodiment, the invention is directed to an apparatus comprising an elongate frame, a first vise assembly, a second vise assembly, opposed first and second roller assemblies, a roller positioning assembly, and a retainer assembly. The elongate frame has a frame axis. The vise assemblies are disposed on the frame in side-by-side relationship for connecting and removing a pipe segment from a pipe string. The roller assemblies are supported on the frame and configured to rotate a pipe section without gripping. The roller positioning assembly causes relative movement between the opposed roller assemblies in a direction transverse to the frame axis. The retainer assembly is supported on the frame in spaced relationship to the vise assemblies and configured to grip a pipe section without rotation.

In another embodiment, the invention is directed to an apparatus comprising a first roller assembly, a second roller assembly, and a cylinder. The first and second roller assembly are opposed to one another and each comprise at least one roller. The cylinder is disposed between the first and second roller assemblies and configured to cause relative movement between the opposed roller assemblies. A spiral ramp is formed on the external surface of at least one roller.

DESCRIPTION OF THE PREFERRED EMBODIMENTS

Figure 1:
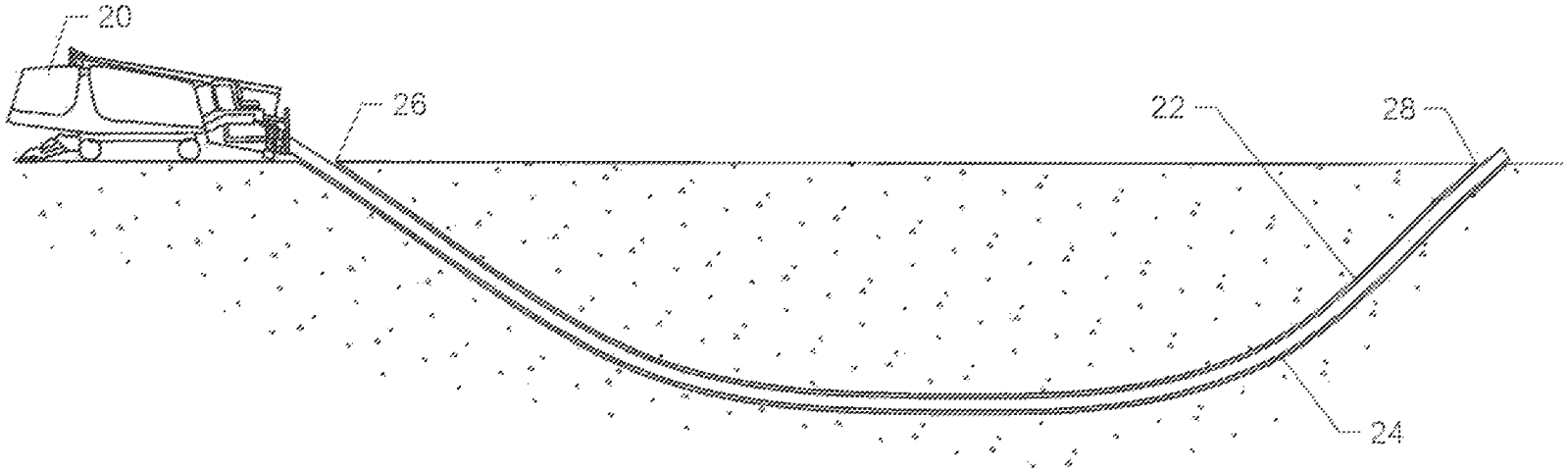
FIG. 1 shows a horizontal directional drilling operation.

Referring now to the drawings, FIG. 1 illustrates the use of directional drilling machine 20 to thrust and rotate a drill string 22 to drill a borehole 24 from an entry point 26 to an exit point 28. The following figures illustrate the use of a tool for use at the exit point 28 to disconnect pipe sections from the drill string 22. The directional drilling machine 20 may be utilized with a one-pipe or two-pipe drill string. Examples of such directional drilling machines are found in U.S. Pat. No. 7,011,166, issued to Koch et. al., the contents of which are incorporated by reference herein.

Figure 2A:
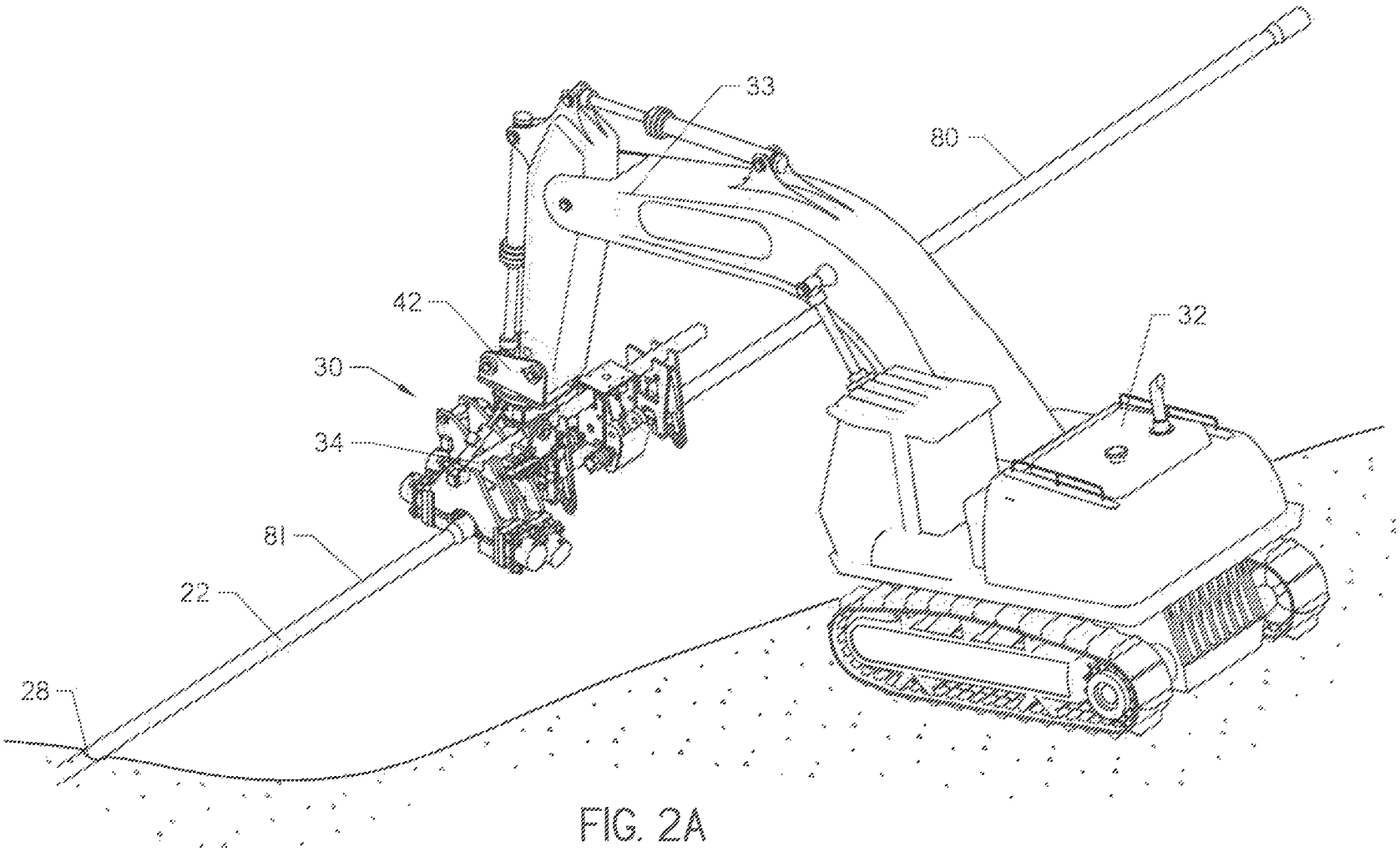
FIG. 2A is a perspective view of an exit side tool that has been suspended from a hydraulic machine and is in use with a made-up drill string.
Figure 2B:
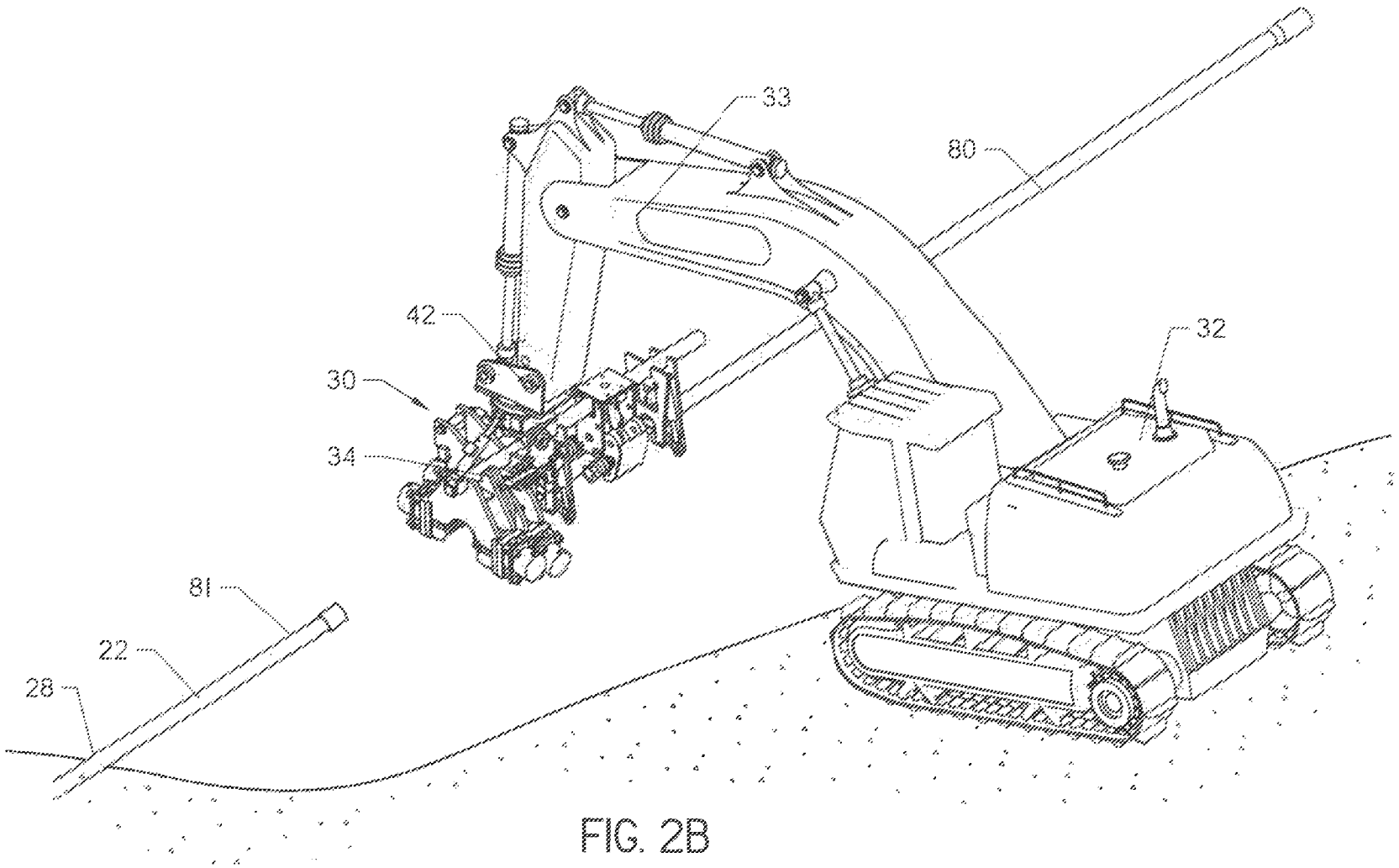
FIG. 2B is a perspective view of the exit side boring tool of FIG. 2A at a later stage of string disassembly. The boring tool holds a pipe section that has been disconnected from the drill string.

With reference now to FIGS. 2A-2B, shown therein is an embodiment of a pipe handler, or tool 30 that may be employed at the exit point 28 of the borehole to perform various functions on or with respect to the drill string 22. The tool 30 may be used in conjunction with a hydraulic machine 32 such as an excavator or the like. Many types of hydraulic machines may be adapted to provide operative force to the tool 30. Preferably, the tool is used while suspended in the air from an arm attachment 33 on the hydraulic machine 32.

Figure 3:
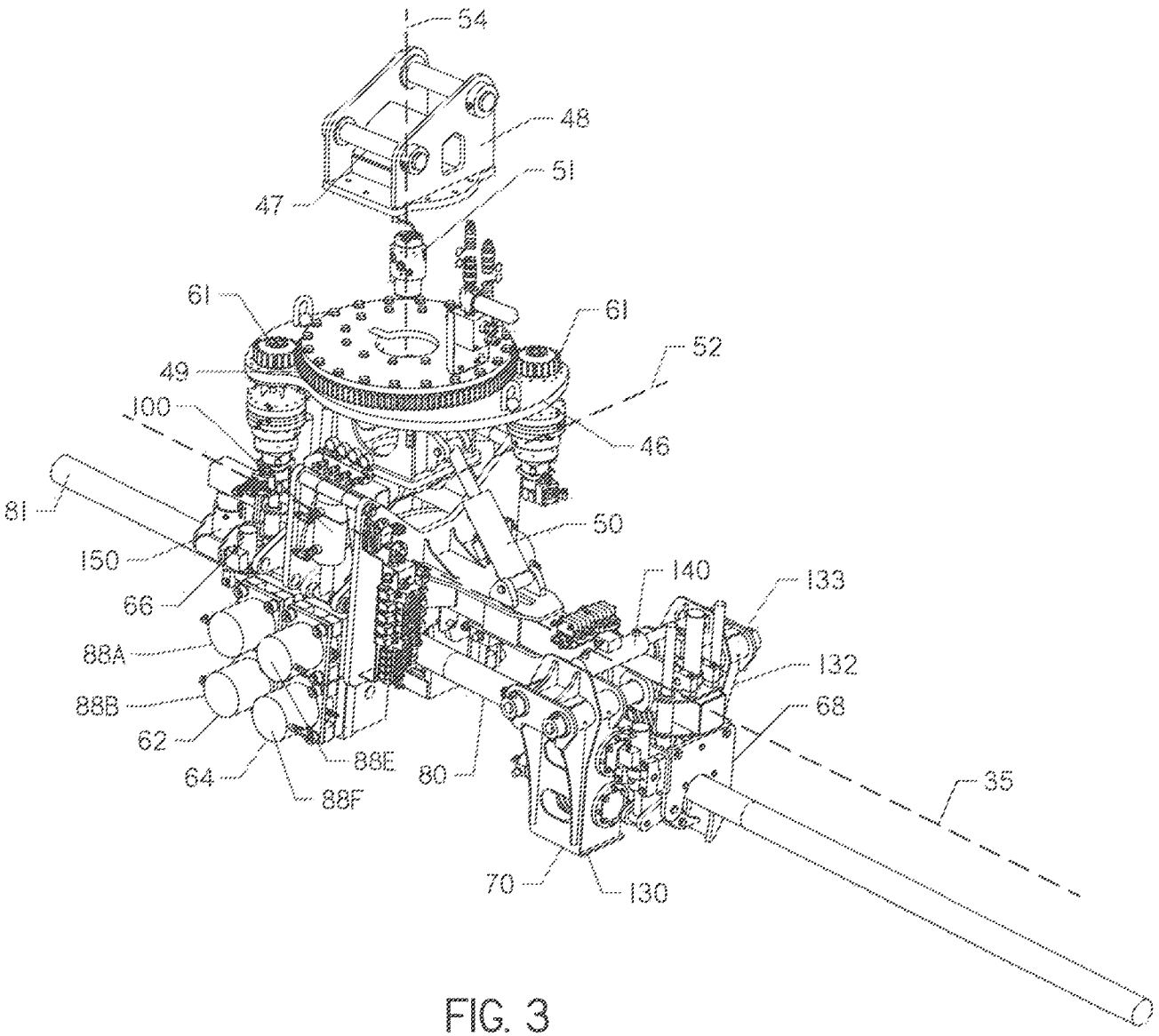
FIG. 3 is a top back right view of an exit side tool.
Figure 4:
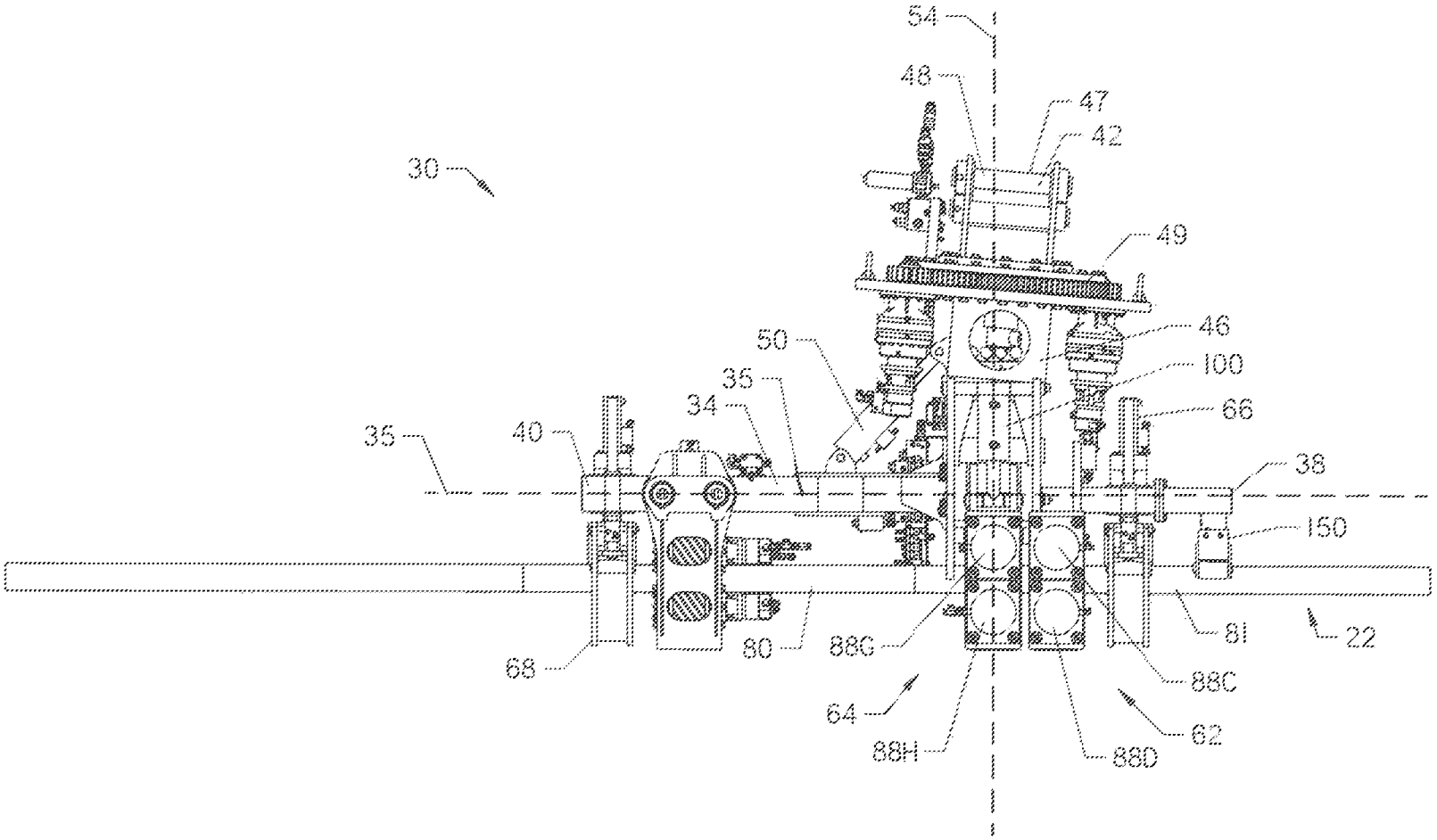
FIG. 4 is a side view of the tool of FIG. 3.

The tool 30 comprises an elongate frame 34. The frame 34 defines a frame axis 35 (FIG. 3) along its length. The frame 34 is connected to the hydraulic machine 32 by an attachment assembly 42 which will be described in greater detail with reference to FIG. 3. With reference now to FIGS. 3-4, the frame 34 may be a solid bar, beam, or other rigid structure. The frame 34 comprises a first end 38 and a second end 40.

In FIG. 2A, the tool 30 is shown with the sections 80, 81 made up, or connected. In FIG. 2B, the tool 30 is shown with the sections 80, 81 disconnected. FIG. 2A shows the configuration of the tool either with makeup-connection of pipe section 80 to drill string 22 just completed. Alternatively, the embodiment of FIG. 2A may be about to begin breakout—that is, the act of removing pipe section 80 from drill string 22. FIG. 2B shows the tool 30 transferring a disconnected pipe section 80, such as may occur just after breakout or just before makeup of the pipe section 80.

The frame 34 must generally be aligned parallel with the drill string 22 at the exit side 28 in order to be properly oriented. Therefore, it is provided with the attachment assembly 42 to orient the frame 34. The attachment assembly 42 comprises a base 46 and an attachment bracket 48. The attachment assembly 42 provides a pivotal connection such that the tool 30 may be properly oriented to the drill string 22 for makeup or breakout of pipe sections 80 to or from adjacent pipe sections 81.

The frame 34 is pivoted about a first axis 52 by a hydraulic cylinder 50 disposed between the base 46 and the frame. The attachment bracket 48 comprises an external gear 49. The frame 34 and base 46 rotate about a second axis 54 relative to the attachment bracket 48. As shown, two motorized gear drives 61 supported by the base 46 actuate this rotation. The drives 61 interact with geared connection 49. This interaction causes relative rotation between the base 46 and gear 49. A hydraulic swivel 51 may be provided within the assembly as shown in FIG. 3.

Alternative means of rotation of the base 46, such as an internal gear drive, slewing drive, hydraulic cylinder or the like may be used. The gear 49 and gear drives 61 allows for full 360 rotation the tool 30 about the attachment bracket 48. The frame 34 is manipulated by hydraulic cylinder 50 and gear drives 61 such that it is substantially parallel with a section of pipe 80 to be removed.

With continued reference to FIGS. 3-4, the frame 34 supports and provides attachment for multiple additional components of the tool 30. The tool 30 comprises a first vise assembly 62, a second vise assembly 64, a first retainer assembly 66, a second retainer assembly 68, and a roller assembly 70. These assemblies work in concert to makeup, or connect, and breakout, or loosen, sections of pipe in accordance with the invention. In general, the retainer assemblies 66, 68 orient the frame relative to the pipe sections 80, 81 and allow for handling of disconnected pipe sections. The vise assemblies 62, 64 allow for high-torque relative rotation of adjacent pipe sections 80, 81. The roller assembly 70 threads the pipe section 80 to or from the adjacent pipe section 81.

With reference to FIGS. 3-4 and 8-9, the first vise assembly 62 and second vise assembly 64 are supported in side-by-side relationship on the frame. One vise assembly is configured to grip and rotate a pipe section. The other vise assembly is configured to grip a pipe section without rotation. Each comprise at least one jaw 87 on each side, actuated by one or more actuators 88. In one embodiment, first vise assembly 62 comprises actuators 88*a*, 88*b*, 88*c*, and 88*d*. The second vise assembly comprises actuators 88 *e-h*. The actuator 88*a-f* may comprise hydraulic motors, cylinders, rams or other suitable actuators.

Each actuator 88*a-h* causes its adjacent jaw 87 to extend or retract. When opposing pair of jaws 87 are moved to a gripping position, a pipe section 80 disposed within the vise 62, 64 is gripped. Each jaw is mounted so as to be moveable with respect to each other between an gripping position and a non-gripping position in which the jaws may grip a pipe section. Thus, the jaws 87 of the first vise assembly 62 will cooperate to grip a pipe section when in the gripping position.

Each jaw 87 supports one or more die holders 89. The die holders 89 aid in increasing the friction between the jaws 87 and the pipe section 80, preventing slippage during makeup and breakout. By providing two die holders 89 per jaw, the vise assemblies 62, 64 can accommodate various sizes of pipe by contacting the pipe section at four distinct points.

The first vise assembly 62 is fixed relative to the frame 34 and the second vise assembly 64 is rotating with respect to the first vise assembly in order to apply a twisting force to a pipe section with respect to an adjacent pipe section that is gripped by the first vise assembly. The tool 30 comprises a linear actuator 100 for moving the second vise assembly 64 relative to the first vise assembly 62. The linear actuator 100 may be a hydraulic cylinder. As shown, there is a linear actuator on each side of the second vise assembly 64, though a single actuator may be used. Extension and retraction of the linear actuator 100 when the first vise assembly 62 is in the closed position will rotate the pipe section 80 relative to an adjacent section 81 in the drill string 22 causing the pipe joint formed between these sections to loosen or tighten, depending on the direction of rotation (FIGS. 2A-2B).

Figure 9:
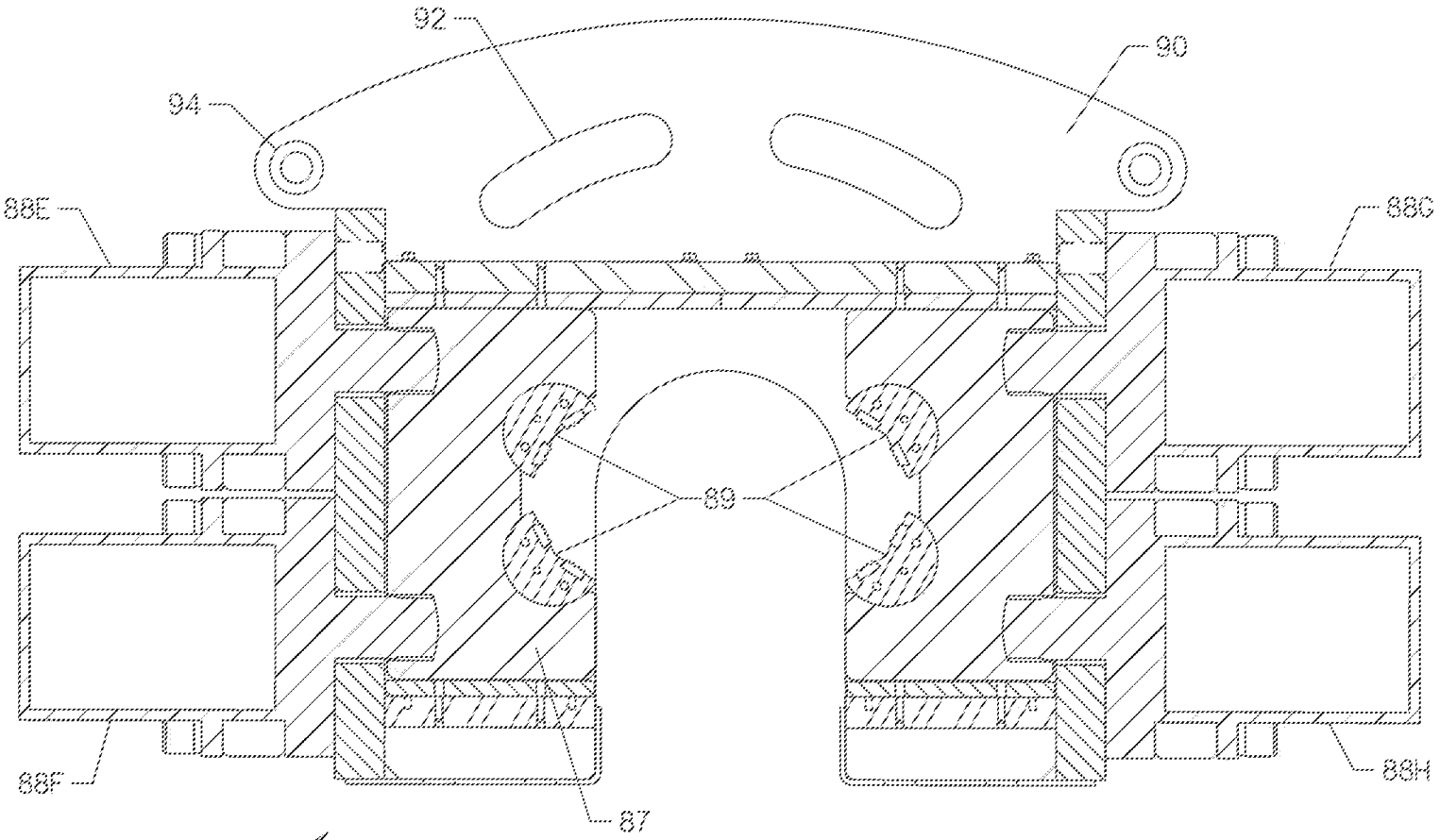
FIG. 9 is a cross-sectional view of a vise assembly.
Figure 12:
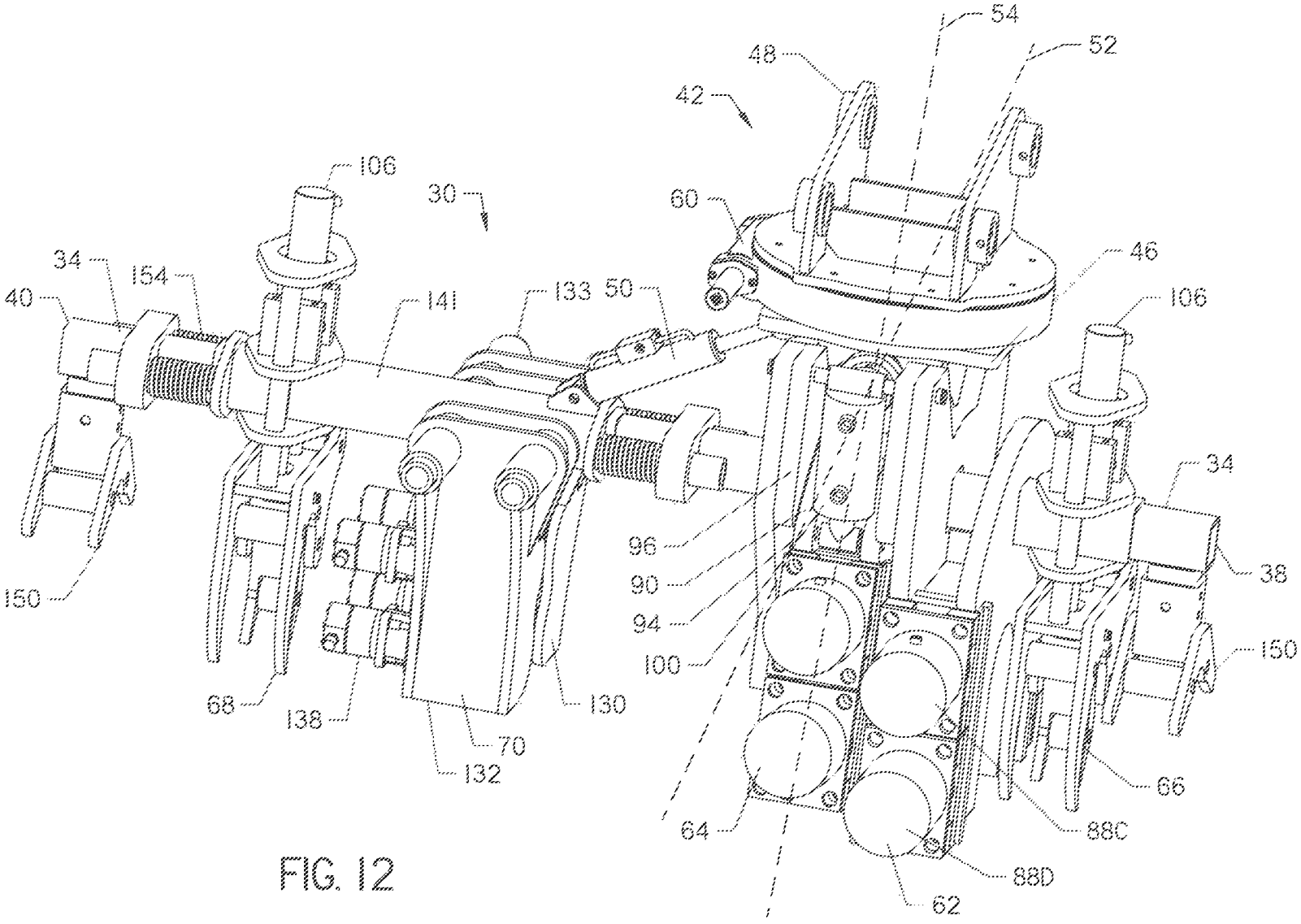
FIG. 12 is a left front perspective view of another embodiment of an exit-side tool.

With reference to FIG. 9, the second vise assembly 64 is supported on a movable frame 90. The frame 90 comprises two slots 92 and two apertures 94. Each linear actuator 100 attaches to the frame 90 at a corresponding connection aperture 94. This causes the frame 90, and thus the second vise assembly 64 to pivot relative to the frame 34. The slots 92 are arcuate in shape and preferably subtend the same included angle. In the embodiment shown in the figures, two slots 92 are provided. Elongate stop elements (not shown) are supported directly on or indirectly by the frame 34. Each stop element projects transversely through a corresponding slot 92. Rotation of the frame 90 and second vise assembly 64 is stopped by engagement of a stop element with an end of the slot 92. The included angle defined by each arcuate slot 92 corresponds to the angular limits of rotation of the second vise assembly 64. With reference to FIG. 12, the linear actuator 100 extends between a bracket 96 supported on frame 34, and the connection point 94 on frame 90, allowing the second vise 64 to rotate.

The second vise assembly 64 may alternatively be fixed and the first vise assembly 62 may be moveable with respect thereto. Rotation of the pipe section 80 away from the pipe string within the ground is advantageous, as it eliminates the need to overcome frictional force due to the subsurface. In another embodiment of the invention (not shown), each of the vise assemblies 62, 64 is independent respect to each other to apply a twisting force to the drill string 22 (FIG. 1). Further, the vise assemblies 62, 64 are preferably rotatable with the frame element 34 relative to the drill string 22.

Figure 5:
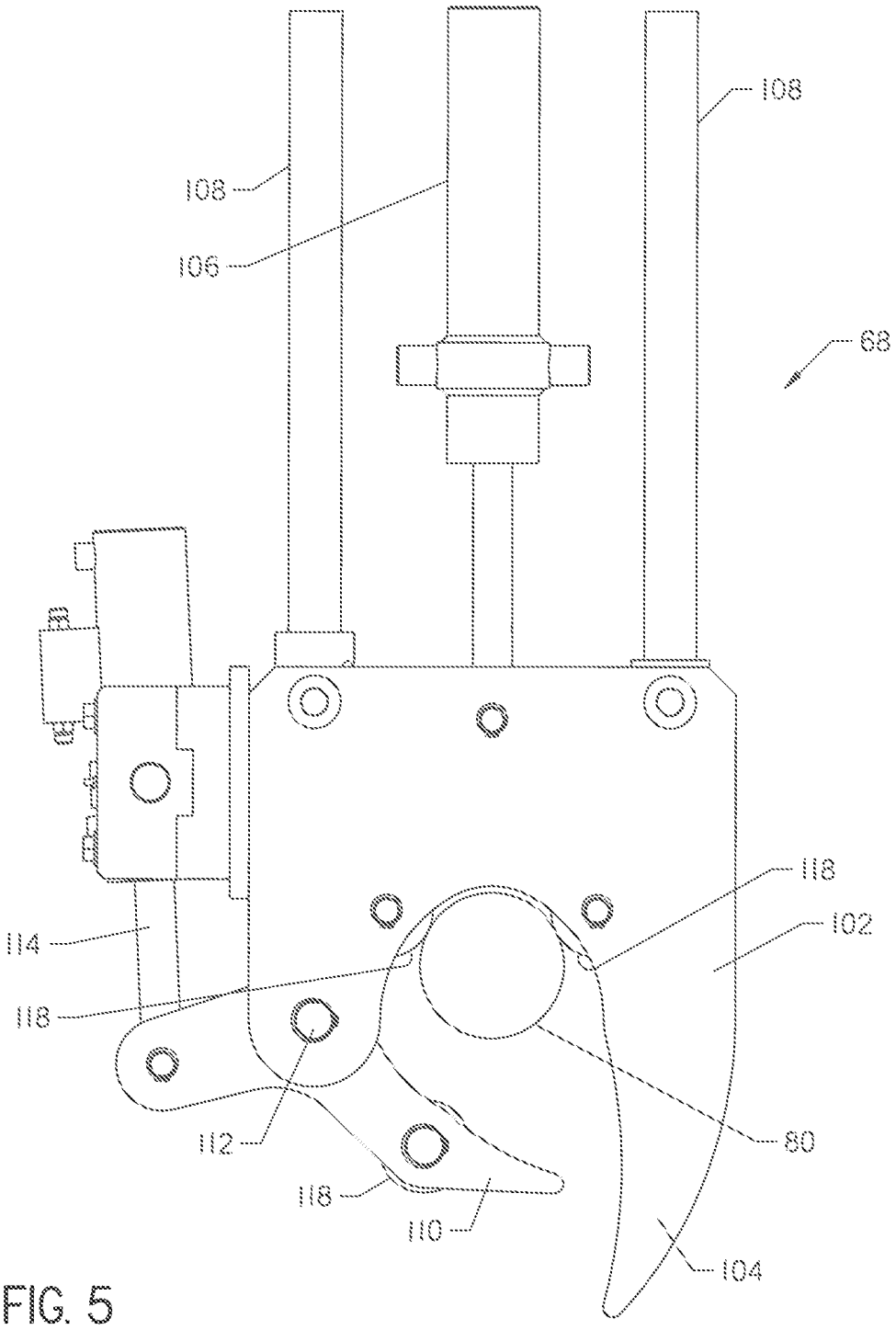
FIG. 5 is an end view of the retainer assembly of FIG. 3.
Figure 6:
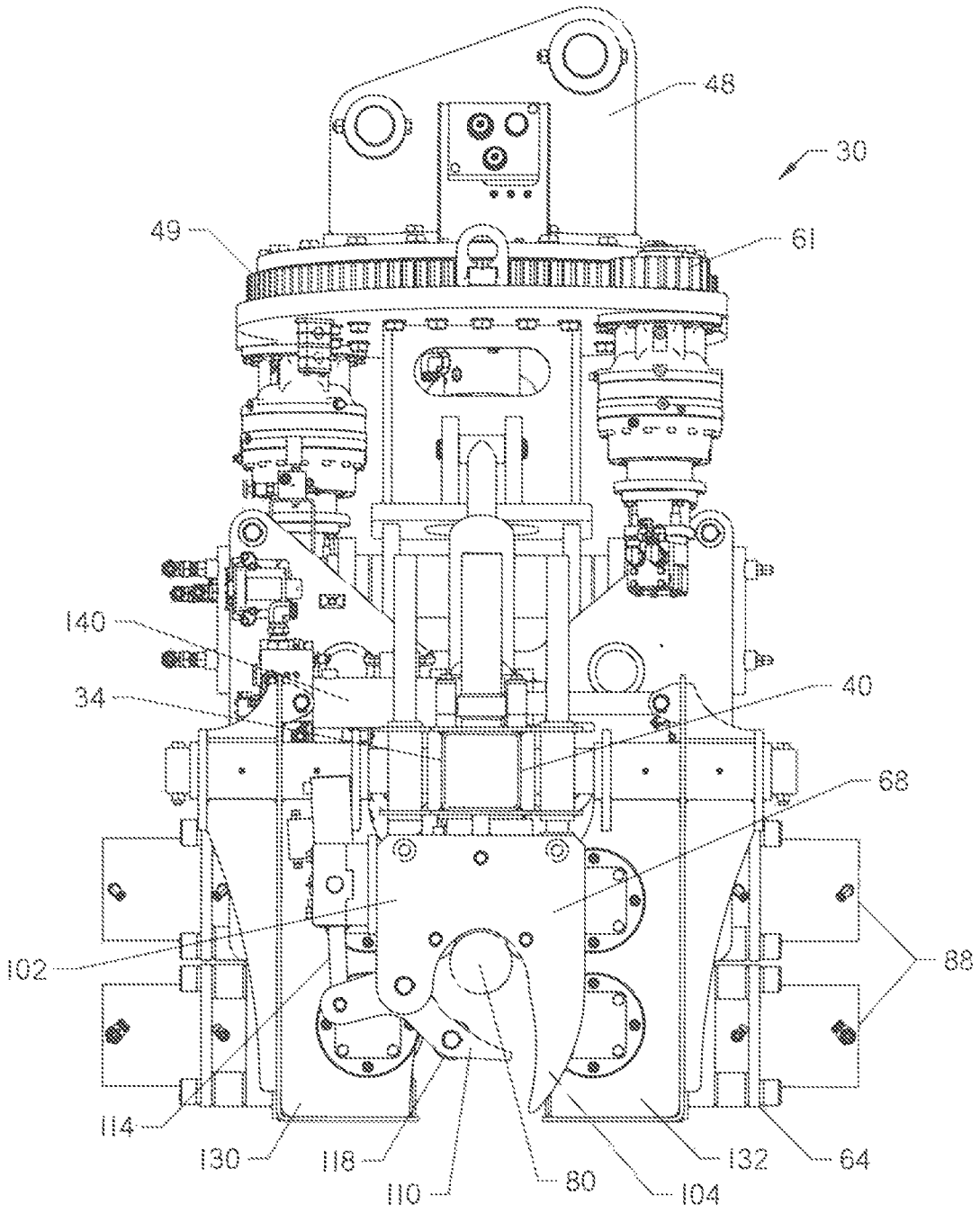
FIG. 6 is a back end view of the tool of FIG. 3.

With reference now to FIGS. 5-6, the retainer assemblies 66, 68 are shown in further detail. The retainer assemblies 66, 68 are supported on the frame in spaced relationship to the vise assemblies and configured to grip a pipe section without rotation. The second retainer assembly 68 comprises at least one bracket frame 102, a positioning assembly such as cylinder 106 and a movable leg 110 that may be pivoted about pivot point 112 by grip control cylinder 114. The bracket frame 102 may comprise a projecting fixed leg portion 104 that is opposed to the movable leg 110. The second retainer assembly 68 comprises two longitudinally spaced bracket frames 102. The movable leg 110 may be moved between an open position that will allow a drill pipe section 80 to be received in the pipe reception opening and a closed position, as shown, that retains the pipe section 80 in the opening. One or more unpowered rollers 118 may be positioned such that the unpowered rollers contact the first pipe section when the retainer assemblies 66, 68 are in a closed position.

As shown, rollers 118 are incorporated into the legs 110, 104 and bracket frame 102 to enable rotation of the pipe sections without frictional resistance due to the retainer assemblies 66, 68 during makeup and breakout. As shown, the rollers 118 comprise bogey wheels. Alternatively, rollers 118 incorporated within the retainer assemblies 66, 68 may be powered (not shown).

The position cylinder 106 is configured to move the retainer assembly 66, 68 in a direction transverse to the longitudinal axis of the frame 34. Two rails 108 provide support for the bracket frame 102 while allowing the cylinder 106 to adjust the position of the frame. The cylinder 106 allows the pipe section 80 to be centered within the retainer assembly 68.

The first retainer assembly 66 may have identical components as the second retainer assembly 68. As shown, the second retainer assembly 68 is proximate the second end 40 of the frame and the first retainer assembly 66 is proximate the first end 38 of the frame With reference again to FIGS. 3-4 and FIGS. 10-11, the roller assembly 70 comprises means for rotating a pipe section 80 that is received in the second retainer assembly 68 about a long axis of the pipe section without gripping. The roller assembly 70 may be used to rotate a drill pipe section to engage the threads or disengage the threads of the threaded connectors of drill pipe section 81. In the embodiments shown herein, second vise assembly 64 has limited angular extent of its twisting force. This would require second vise assembly grip, twist and release the pipe section 80 multiple times to disconnect it from the drill string. The roller assembly 70 is provided to overcome this limitation by rotating without gripping the pipe section.

Figure 10:
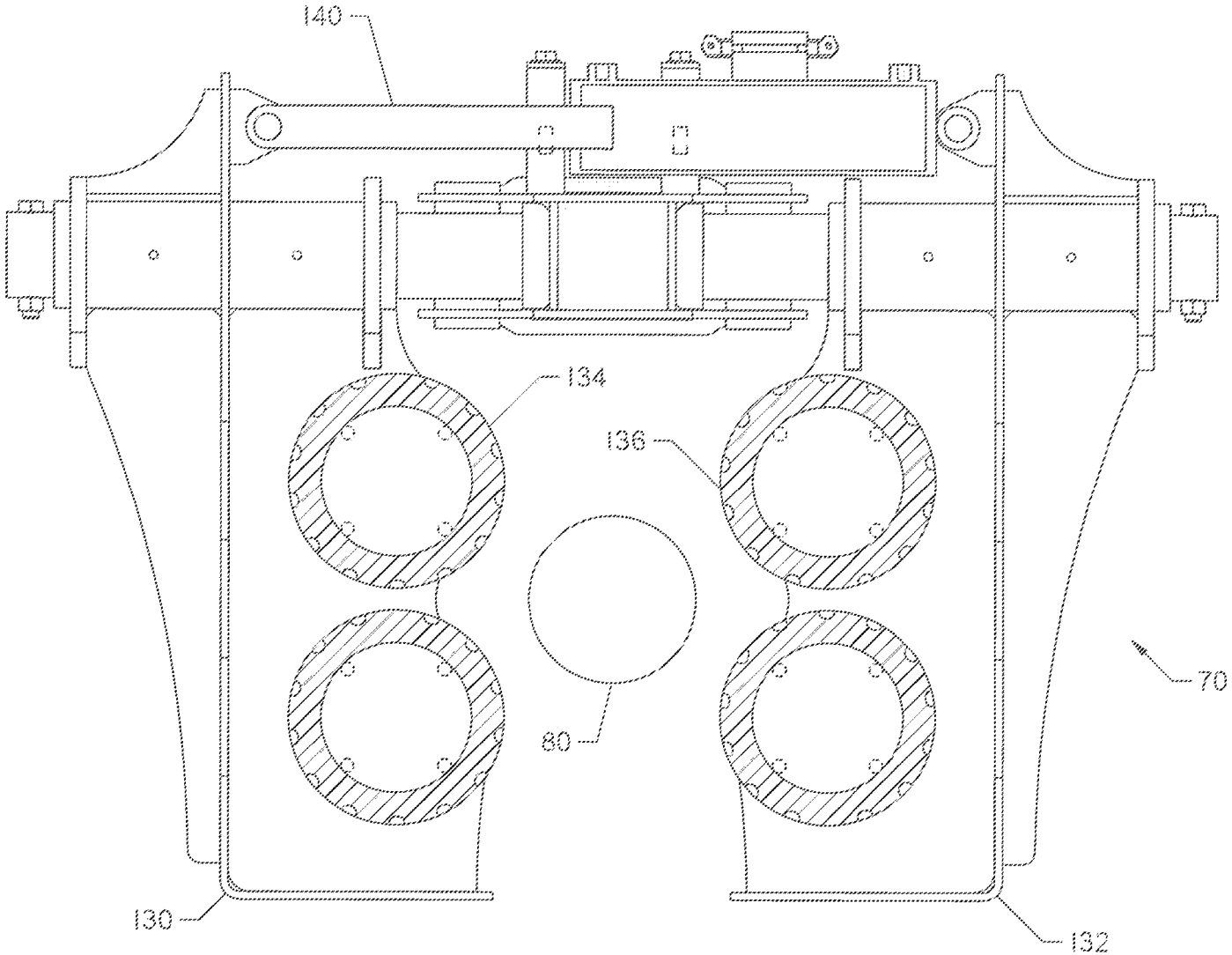
FIG. 10 is an end view of a roller assembly of FIG. 3.
Figure 11:
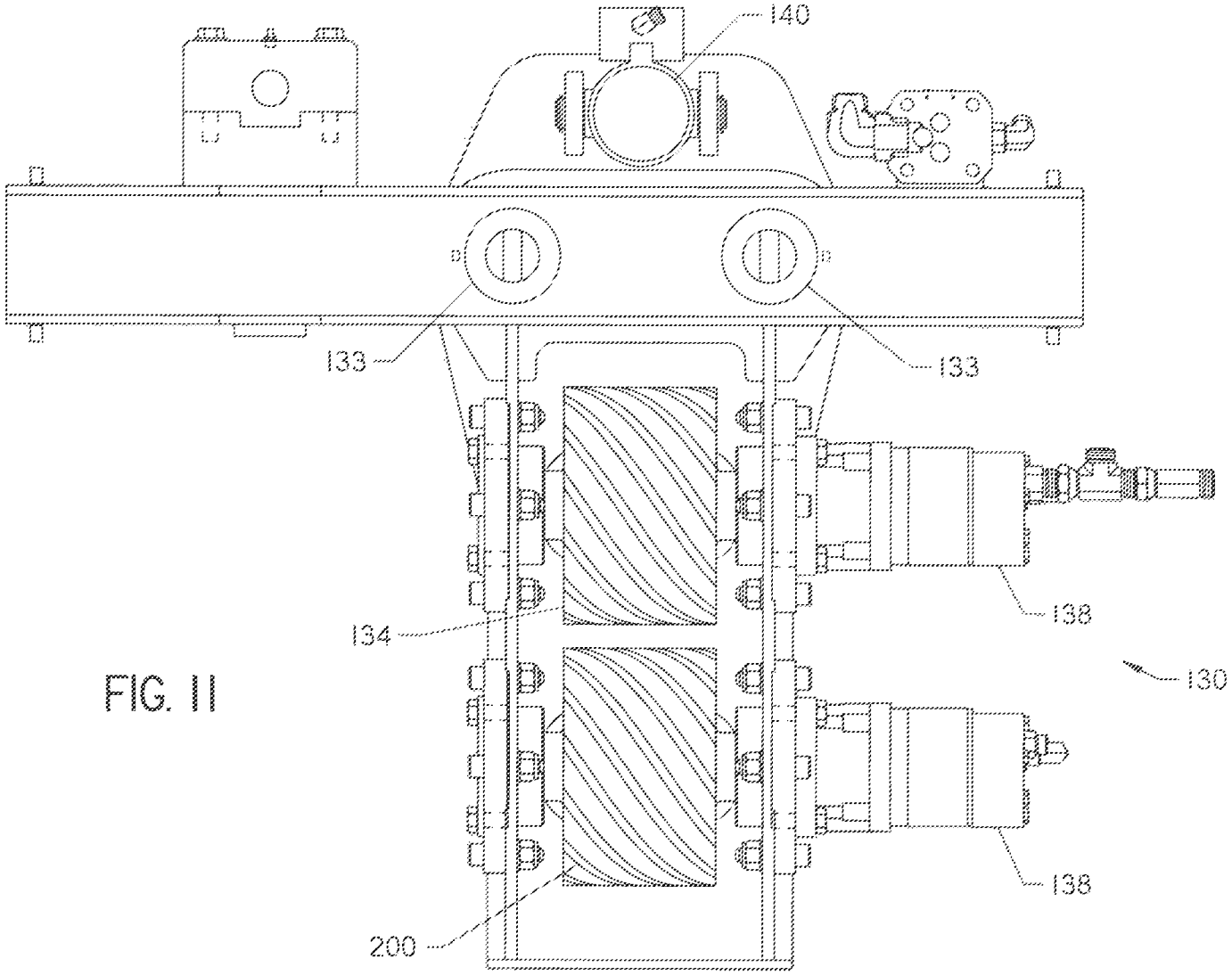
FIG. 11 is a sectional side view of the roller assembly of FIG. 10.

The roller assembly 70 comprises first roller arm 130 comprising a first roller 130 and second roller arm 132 comprising a second roller 136. First roller arm 130 and second roller arm 132 are suspended from one or more rails 133. The rails extend transverse to the frame 34. The rails 133 allow the arms 130, 132 to move laterally with respect to the frame 34. Preferably, each roller arm 130, 132 comprises a plurality of rollers that are rotationally driven by rotation motors 138. As shown in FIG. 10, each roller arm 130, 132 preferably comprises two rollers. Rotation of the rollers 134, 136 imparts a spin to the pipe section, thereby disengaging pipe section 80 from an adjacent section 81. As shown, four motors 138 and rollers 134, 136 are utilized, though different numbers of rollers may be utilized without departing from the spirit of the invention.

The powered rollers 134, 136 each comprise a spiral ramp 200 (FIG. 11), such as a groove or a ridge disposed about its surface. Such ramp 200 provides frictional contact between the rollers 134, 136 and the pipe section 80. The spiral ramp 200 provides an axial force to the pipe section 80 (FIG. 10). The direction of that axial force depends on the direction of rotation of the rollers 134, 136. Preferably, the direction of the ramp 200 on the roller surface (e.g. right hand) matches the direction of thread on the pipe section 81 that the rollers 134 and 136 engage. As such, the pipe section 80 is translated away from the vise assembly 62, 64 during breakout rotation. Conversely, the pipe section 80 is translated toward the vise assembly 62, 64 during makeup rotation.

Roller assembly 70 may be operated to impart a tightening spin to a pipe section or other component on the exit side of the bore by rotating the first and second rollers in the opposite direction to that which is used to disengage the pipe section 80. Therefore, motors 138 are preferably bidirectional.

A positioning assembly such as roller assembly cylinder 140 extends between the first roller arm 130 and the second roller arm 132. The roller assembly cylinder 140 is configured to cause relative movement between the opposed roller assemblies in a direction transverse to the frame axis. The cylinder 140 extends parallel to the rails 133. Thus, retraction of the cylinder 140 causes first roller arm 130 and second roller arm 132 to slide along rails 133 toward one another. Changing the separation distance between the first roller arm 130 and second roller arm 132 allows the tool 30 to accommodate multiple diameters of pipes.

In an alternative embodiment of the roller assembly 70, as shown in FIG. 12, the roller assembly 70 is disposed on a roller assembly frame 141. The roller assembly frame 141 is hollow and coaxially supported on frame 34 between two spring assemblies 154. The spring assemblies 154 are disposed between frame 141 and main frame 34. In FIG. 12, the roller assembly 70 can move relative to the vise assemblies 62, 64 due to movement of the roller assembly frame 141 preventing binding. Roller assembly cylinder 140 is not shown in FIG. 12.

The tool 30 may further comprise a control valve assembly (not shown) that is connected to an auxiliary hydraulic circuit of a hydraulic machine such as hydraulic machine 32 (FIGS. 2A-2B), that may be used to control the various pipe gripping and torque requirements for the operation of the first and second vise assemblies 62, 64, the first and second retainer assemblies 66, 68, and the roller assembly 70. Preferably, a pressure reducer may be provided to keep control valve assembly from receiving hydraulic fluid at a pressure higher than about 3000 psi from the hydraulic machine 32.

The control valve assembly may include a radio control receiver that is operatively connected to the hydraulic actuators of the tool 30 and the cylinders 50, 60 (FIG. 3). The radio control receiver is adapted to communicate with a remote controller (not shown) for remote operation of the tool 30.

Figure 7:
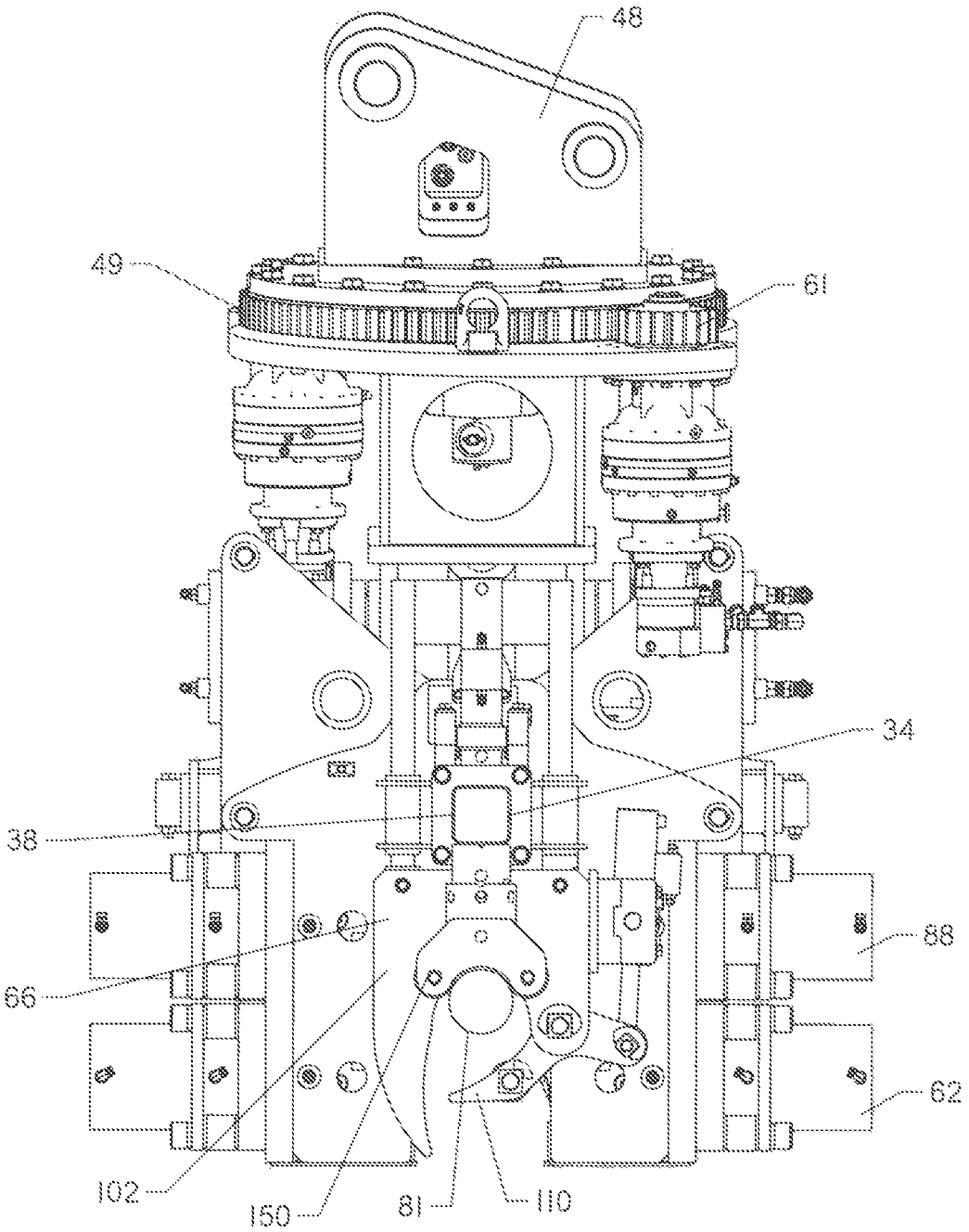
FIG. 7 is a front end view of the tool of FIG. 3.
Figure 8:
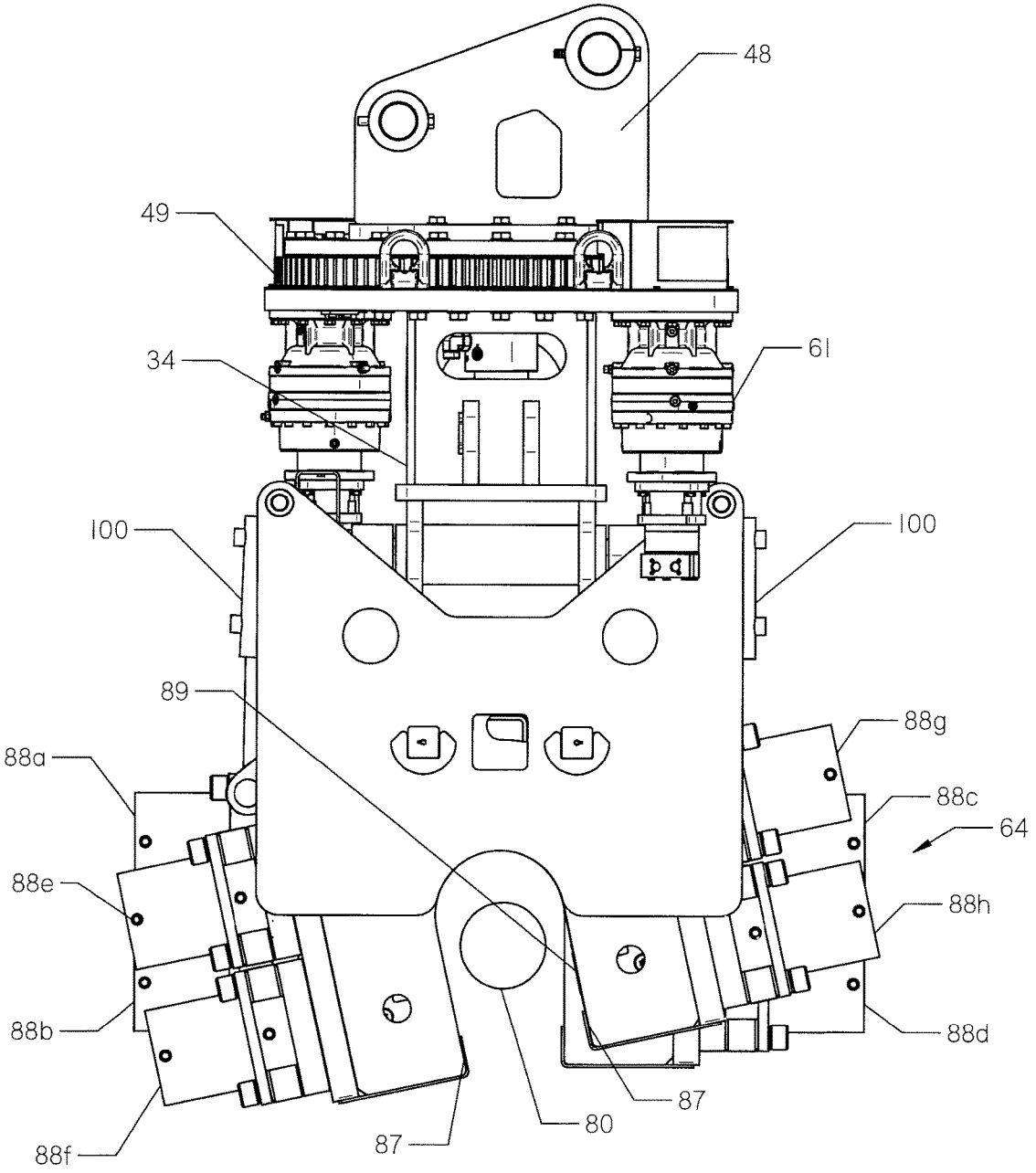
FIG. 8 is a back end view of a vise assembly of FIG. 3.

With reference to FIGS. 4, 7 and 12, the tool 30 comprises at least one pipe guide 150. The pipe guide is removably supported on the frame 34. Thus, for a particular diameter of pipe, a particular pipe guide 150 provides a stop at the correct distance between the pipe section 81 and the frame 34. This positions the pipe in the center of first vise 62. The pipe guide 150 can be removed when the shape of the drill string 22 or an attachment, such as a backreamer, require more clearance relative to the frame 34 than provided when pipe guide 150 is used.

In operation, an operator or automatic controller may utilize the features of the tool 30 to make up and break out sections of pipe from the exit end of drill string 22. Typically, the first phase of operation is breakout, after a drilling machine 20 (FIG. 1) advances a boring tool to an exit side 28 of the borehole 24.

After exiting the borehole, the drill string 22 has a pipe section 80 at its exposed end. The pipe section 80 contacts its adjacent pipe section 81 at a joint. To disconnect the pipe section 80 from the drill string 22, the tool 30 is first moved to position the joint between the first and second vise assemblies 62 and 64.

The attachment assembly 42 permits any pivoting and rotation of the frame 34 that might be needed to position the tool 30 as required. When in position, the first retainer assembly 66 is closed about the pipe segment 81. The second retainer assembly 68 may likewise be closed about the pipe segment 80. The level of the frame 34 relative to the pipe segments 80, 81 may be adjusted using the position cylinders 106 (FIG. 5) to properly orient the pipe within the vise assemblies 62, 64 and roller assembly 70. Different pipe diameters will require different positions of the retainer assemblies 66, 68 for optimum position.

The first vise assembly 62 and second vise assembly 64 then grip the pipe segments 80, 81. Pipe segment 80 is rotated by the second vise 64, breaking its high-torque connection with adjacent segment 81. Once this high-torque connection is broken, the second vise 64 is released and roller assembly 70 may rotate the pipe segment 80. Preferably, the ramp 200 on each roller 118 of the roller assembly 70 helps to translate the pipe segment 80 away from adjacent pipe segment 81. When the pipe segment 80 is fully unthreaded, the first retainer 66 and first vise 62 may be opened, and the pipe segment 80 moved to a storage location while being held in second retainer 68.

The second phase of operation, typically, is makeup of product pipe which is pulled back through the borehole 24 by the drilling machine 20, usually behind a backreamer or other hole enlarging mechanism. During makeup, a pipe segment 80 is placed in the second retainer 68 and moved proximate the exit side of the drill string 22 generally, and an adjacent pipe segment 81 specifically. The frame 34 should be rotated and tilted relative to arm 33 in order to orient the pipe segment 80 with a longitudinal axis of the adjacent pipe section 81, as shown in FIG. 2B.

The first retainer 66 and second retainer 68 may be used in concert to properly position the frame 34 relative to the pipe sections 80, 81 such that they are centered within the vise assemblies 62, 64 and roller assembly 70. The first retainer 66 should close about pipe segment 81 such that it is centered within first vise 62. First vise 62 may then be closed about the pipe segment 81. The pipe segment 80 is then advanced toward pipe section 81 and threaded thereto by operation of the roller assembly 70.

Once threaded, pipe section 80 may be gripped by second vise 64, then rotated by second vise 64 to create a high-torque connection. Once the high-torque connection between segments 80, 81 is complete, the retainer assemblies 66, 68 and vises 62, 64 may be released and the drill string 22 advanced into the exit side 28 of borehole 24 by the drilling machine 20.

While the preferred modes of operation and configurations are disclosed herein, one of ordinary skill in the art could envision alternative designs which would not depart from the spirit of the disclosed and claimed invention.

What is claimed is:

1. An apparatus comprising:

an elongate frame having a frame axis;

first and second vise assemblies supported in side-by-side relationship on the frame, the first vise assembly configured to grip and rotate a first pipe section, and the second vise assembly configured to grip a second pipe section without rotation;

a retainer assembly supported on the frame in spaced relationship to the vise assemblies and configured to grip the first pipe section without rotation; and a positioning assembly configured to move the retainer assembly in a direction transverse to the frame axis;

wherein the first vise assembly contacts the first pipe section at four distinct points on the first pipe section.

2. The apparatus of claim 1 further comprising a second retainer assembly identical to the retainer assembly supported on the frame in spaced relationship to the vise assemblies and configured to grip the second pipe section without rotation, and a second positioning assembly configured to move the second retainer assembly in a direction transverse to the frame axis.

3. The apparatus of claim 1 further comprising:

opposed first and second roller assemblies supported on the frame and configured to rotate the first pipe section without gripping;

wherein the positioning assembly is configured to cause relative movement between the opposed roller assemblies in a direction transverse to the frame axis.

4. The apparatus of claim 3 wherein the first roller assembly and second roller assembly each support two powered rollers.

5. The apparatus of claim 4 wherein each of the powered rollers comprises a spiral ramp disposed about the surface of the powered roller.

6. The apparatus of claim 5 further comprising a second retainer assembly identical to the retainer assembly supported on the frame in spaced relationship to the vise assemblies and configured to grip the second pipe section without rotation, and a second positioning assembly configured to move the second retainer assembly in a direction transverse to the frame axis.

7. The apparatus of claim 1 wherein the first vise assembly is adjusted from a non-gripping position to a gripping position by two sets of two cylinders.

8. The apparatus of claim 1 wherein each vise assembly comprises an opposed pair of jaws, and in which at least two spaced and protruding die holders are supported on each jaw.

9. The apparatus of claim 1 wherein the retainer assembly comprises a plurality of unpowered rollers positioned such that unpowered rollers contact the first pipe section when the first retainer assembly is in a closed position.

10. A system comprising the apparatus of claim 1 and an excavator comprising an arm, wherein the apparatus is disposed from the arm.

11. The system of claim 10 further comprising a hydraulic cylinder disposed between the arm and the apparatus, such that extension and retraction of the hydraulic cylinder pivots the apparatus relative to the arm.

12. The system of claim 10 wherein the apparatus may be rotated a full 360 degrees about its linkage with the arm.

13. The apparatus of claim 1 further comprising a cylinder for adjusting a position of the retainer assembly in a direction transverse to the frame axis.

14. The apparatus of claim 1 further comprising:

a first roller assembly comprising at least one roller;

a second roller assembly opposed to the first roller assembly and comprising at least one roller; and a cylinder disposed between the first roller assembly and the second roller assembly and configured to cause relative movement between the opposed roller assemblies;

wherein a spiral ramp is formed on the external surface of at least one roller.

15. The apparatus of claim 14 wherein the spiral ramp protrudes from a periphery of the roller.

16. The apparatus of claim 14 further comprising:

a second retainer assembly identical to the retainer assembly, wherein the second retainer assembly is supported on the frame in spaced relationship to the vise assemblies and the retainer assembly; and a second positioning assembly configured to move the second retainer assembly in a direction transverse to the frame axis.

17. An assembly comprising the apparatus of claim 16 and an excavator comprising an arm, wherein the system is disposed from the arm.

* * * * *